United States Patent [19]

Barbieri

[11] Patent Number: 4,571,247

[45] Date of Patent: Feb. 18, 1986

[54] PRODUCT IN TABLET FORM FOR USE IN THE CHEMICAL ELIMINATION OF SOOT FROM CHIMNEYS AND SMOKE DUCTS

[75] Inventor: Bruno Barbieri, Cremona, Italy

[73] Assignee: Cavallino S.N.C. Prodotti Chimici, Cremona, Italy

[21] Appl. No.: 706,098

[22] Filed: Feb. 27, 1985

[30] Foreign Application Priority Data

Mar. 19, 1984 [IT] Italy ..... 20119 A/84

[51] Int. Cl.[4] ..... C10L 10/00; C10L 10/02; C10L 10.04; C01L 10/06

[52] U.S. Cl. ..... 44/5; 208/48 AA; 44/4

[58] Field of Search ..... 44/5; 208/48 AA

[56] References Cited

U.S. PATENT DOCUMENTS

| | | | |
|---|---|---|---|
| 2,141,848 | 12/1938 | Adams et al. | 44/5 |
| 2,610,112 | 9/1952 | Chenicek | 44/5 |
| 2,777,761 | 1/1957 | Tarnoski | 44/5 |
| 2,845,338 | 7/1958 | Raynar et al. | 44/5 |
| 4,481,010 | 11/1984 | Mackowiak et al. | 44/5 |
| 4,514,256 | 4/1985 | Kober et al. | 44/5 |

FOREIGN PATENT DOCUMENTS

| | | | |
|---|---|---|---|
| 1538610 | 3/1957 | Canada | 44/5 |
| 1849732 | 9/1960 | United Kingdom | 44/5 |

*Primary Examiner*—D. E. Gantz
*Assistant Examiner*—Helane Myers
*Attorney, Agent, or Firm*—Stevens, Davis, Miller & Mosher

[57] ABSTRACT

A product for eliminating soot from chimneys and smoke ducts in general by inducing the complete combustion thereof, for use in the form of tablets which are introduced into the hearth of the combustion appliance. Said tablets are constituted essentially by a mixture of the following components: cupric chloride, ammonium chloride, stearin and/or paraffin, sulphur and tableting binders and auxiliaries such as talc and starch.

3 Claims, No Drawings

PRODUCT IN TABLET FORM FOR USE IN THE CHEMICAL ELIMINATION OF SOOT FROM CHIMNEYS AND SMOKE DUCTS

This invention relates to a product suitable for use in the form of tablets, for eliminating soot and general carbon deposits from chimneys and smoke ducts of boilers, stoves etc.

Products for use in powder form are known for this purpose, they being introduced periodically into the hearth of the combustion appliance. They burn therein to develop products which are volatile or are entrained in finely dispersed form by the smoke, to thus reach the chimney or smoke duct walls covered with soot, where they induce combustion of this latter and thus its complete elimination.

In these cases, the combustion of the powdery product is not easily controllable, and in most cases is too rapid.

Some of these products contain strongly oxidising substances (nitrates) which sometimes induce violent combustion to the extent of actual explosion, and are therefore dangerous in practical use.

In other cases, the product is applied to all the soot-covered walls by suitable equipment (atomisers, sprayers). On then operating the combustion appliance, the soot is eliminated by virtue of its complete combustion.

The use of such equipment and procedures would obviously be too costly for small domestic combustion plants and appliances.

The present invention provides a product in the form of tablets which are introduced into the hearth where they burn regularly and slowly, to develop smoke containing active substances which by catalytic action favour complete combustion of the soot and general carbon deposits present in the chimney or in the smoke duct. The product according to the invention does not need to be weighed out by the user as it is already in the form of tablets of predetermined weight, and is free from any danger or drawback. In particular, it does not lead to violent combustion (explosions) or the development of highly corrosive or toxic gas as in the case of certain known products of high sulphur content.

The product according to the invention is constituted essentially by the following components:

cupric chloride from 5% to 15% by weight
ammonium chloride from 1% to 5% by weight
stearin and/or paraffin from 65% to 85% by weight
tableting binders and auxiliaries such as talc and starch from 5% to 15% by weight
sulphur from 0.2% to 5% by weight It is prepared by mixing said components in the powder state and then tableting the mixture obtained by compression.

One or two tablets of about 8 g each are sufficient for the periodic cleaning (normally every 10 days) of a domestic combustion appliance such as a stove or small boiler operating on wood, coal, liquid fuel (kerosine, gas oil) or gas.

A typical formulation according to the invention is as follows:

cupric chloride 8% by weight
ammonium chloride 2% by weight
stearin and/or paraffin about 80% by weight
talc and starch about 10% by weight
sulphur 0.3% by weight

I claim:

1. A product in tablet form for eliminating soot and other carbon deposits from chimneys and smoke ducts, consisting essentially of the following components:

cupric chloride from 5% to 15% by weight
ammonium chloride from 1% to 5% by weight
stearin and/or paraffin from 65% to 85% by weight
tableting binders and auxiliaries selected from the group consisting of talc and starch from 5% to 15% by weight
sulphur from 0.2% to 5% by weight

2. A product as claimed in claim 1, having the following composition:

cupric chloride 8% by weight
ammonium chloride 2% by weight
stearin and/or paraffin about 80% by weight
talc and starch about 10% by weight
sulphur 0.3% by weight

3. A method for eliminating soot and other carbon deposits from chimneys and smoke ducts in general, consisting of introducing one or more tablets of the product claimed in claim 1 into the combustion zone of the appliance (stove, fireplace, boiler), during the operation thereof.

* * * * *